US008732882B2

(12) United States Patent
Qin et al.

(10) Patent No.: US 8,732,882 B2
(45) Date of Patent: May 27, 2014

(54) THREE-TRUSS CONTINUOUS STEEL TRUSS GIRDER-PUSHING DEVICE AND ARRANGEMENT METHOD THEREOF

(75) Inventors: Shunquan Qin, Hubei (CN); Juntang Li, Hubei (CN); Wainan Zhou, Hubei (CN); Jie Song, Hubei (CN); Manming Tu, Hubei (CN); Weiqi Mao, Hubei (CN); Fahai Yao, Hubei (CN); Ruixia Zhang, Hubei (CN); Aihua Zhang, Hubei (CN); Yong Tang, Hubei (CN)

(73) Assignee: China Zhongtie Major Bridge Engineering Group Co., Ltd., Wuhan, Hubei (CN)

( * ) Notice: Subject to any disclaimer, the term of this patent is extended or adjusted under 35 U.S.C. 154(b) by 0 days.

(21) Appl. No.: 13/821,008

(22) PCT Filed: Sep. 2, 2011

(86) PCT No.: PCT/CN2011/079296

§ 371 (c)(1),
(2), (4) Date: Mar. 5, 2013

(87) PCT Pub. No.: WO2012/031538

PCT Pub. Date: Mar. 15, 2012

(65) Prior Publication Data

US 2013/0174361 A1 Jul. 11, 2013

(30) Foreign Application Priority Data

Sep. 6, 2010 (CN) ..... 2010 1 0273070

(51) Int. Cl.
*E01D 21/06* (2006.01)
*E01D 19/00* (2006.01)

(52) U.S. Cl.
CPC ..... *E01D 19/00* (2013.01); *E01D 21/06* (2013.01)
USPC ..... 14/77.1

(58) Field of Classification Search
CPC ..... E01D 19/00; E01D 21/06
USPC ..... 14/74.5, 75, 77.1, 77.3
See application file for complete search history.

(56) References Cited

U.S. PATENT DOCUMENTS 4,259,759 A * 4/1981 Tada ..... 14/73.5
4,320,548 A * 3/1982 Tada et al. ..... 14/77.1
5,566,414 A * 10/1996 Nonaka ..... 14/73.5

(Continued)

FOREIGN PATENT DOCUMENTS

CN 101220580 A 7/2008
CN 101250855 A 8/2008

(Continued)

*Primary Examiner* — Raymond W Addie
(74) *Attorney, Agent, or Firm* — Houtteman Law LLC

(57) ABSTRACT

The present invention claims a three-truss continuous steel truss girder-pushing device and an arrangement method thereof. The device comprises three supporting structures of left, center and right, the three supporting structures are provided respectively with left and right side truss slideway girders and a middle truss slideway girder. The front ends of the slideway girder are provided with an operating platform where horizontal continuous pushing jacks are installed; the front ends of the left and right slideway girder and the center slideway girder are each provided with four vertical lifting jacks. The three-truss continuous steel truss girder-pushing device simultaneously pushes the two side trusses of the steel truss beam only, while the center truss slides passively, thereby improving construction efficiency and reducing construction costs.

12 Claims, 6 Drawing Sheets

(56) References Cited

U.S. PATENT DOCUMENTS

| | | | | |
|---|---|---|---|---|
| 2004/0226118 | A1* | 11/2004 | Buonomo | 14/77.1 |
| 2012/0011665 | A1* | 1/2012 | Porter et al. | 14/75 |
| 2013/0055512 | A1* | 3/2013 | Liu et al. | 14/77.1 |

FOREIGN PATENT DOCUMENTS

| | | | |
|---|---|---|---|
| CN | 101560752 | A | 10/2009 |
| CN | 101603288 | A | 12/2009 |
| CN | 101906755 | A | 12/2010 |

* cited by examiner

THREE-TRUSS CONTINUOUS STEEL TRUSS GIRDER-PUSHING DEVICE AND ARRANGEMENT METHOD THEREOF

FIELD OF THE INVENTION

The present application relates to a bridge construction method and, in particular, to three-truss continuous steel truss girder-pushing device and arrangement method thereof.

BACKGROUND OF THE INVENTION

With the development of economy in China, the bridge construction has gradually extended to the coastal areas, and the steel truss bridges required to be built are increased progressively. In order to span great rivers, the long span or multi-span continuous (or temporary continuous simply-supported) steel truss bridges are often used.

At the present stage, when the long span continuous steel truss bridge is erected and constructed, several construction methods are usually adopted as follows: i) a cantilever erection construction method carried out by using a slinging tower; ii) a method performing the cantilever erection by adding a temporary pier; and iii) a pushing method.

The first two construction methods mentioned above are generally implemented in an individually assembled manner, which has a relatively long construction period and is influenced greatly by construction environment. When the cantilever erection construction is carried out by using the slinging tower, there are many unsafe factors, and the construction process is complex. When the cantilever erection construction is carried out by adding the temporary pier, the temporary pier may incur large invest, high building difficulty, and high costs. In the pushing method, there is no need for large-scale mechanical equipment and temporary pier, resulting in small field occupation, and it may better ensure the quality and shorten the construction period. However, the pushing method has not been applied in the erection of the three-truss continuous steel truss girder in China.

SUMMARY OF THE INVENTION

The technical problem to be solved by the present invention lies in the complex construction and high costs for the three-truss continuous steel truss girder.

In order to solve the above technical problem, the technical solution adopted in the present invention is to provide a three-truss continuous steel truss girder-pushing device including three groups of left, middle and right supporting structures, a slideway girder, vertical pushing jacks and a horizontal continuous pushing jack. The three groups of left, middle and right supporting structures include a row of concrete upright posts which are disposed at each of the front and rear sides of the pier body in a bridge direction, wherein each row of concrete upright posts include three posts, and the upright posts and the pier body form the three groups of left, middle and right supporting structures in the bridge direction; the slideway girder includes three groups of a left and right side truss slideway girders and a middle truss slideway girder which are disposed on the three groups of left, middle and right supporting structures and correspond to the left and right side trusses and the middle truss of the steel truss girder respectively, wherein each group of slideway girder has a bridge longitudinal length larger than one segment of the steel truss girder and is formed of a front and rear slideway girders and a middle slideway girder, the front and rear slideway girders are fixed to a pier cap and the concrete upright posts by pre-embedded members, the middle slideway girder is supported on a pier body, and both ends of the middle slideway girder are fixedly connected to the front and rear slideway girders via bolts respectively; two sliding blocks are arranged side by side at the front and rear ends of each of the three groups of slideway girders respectively; an operation platform is provided in the front of the front slideway girder of the left and right side truss slideway girders, wherein the horizontal continuous pushing jack is installed on the operation platform and is anchored to the rear end of the steel truss girder via a cable, four vertical pushing jacks are provided in the front of each of the left and right side truss slideway girders and the middle truss slideway girder, the sliding block located in the front of each slideway girder is disposed at the rear of the respective vertical pushing jack, and is stopped from forward movement by a positioning block.

In the above three-truss continuous steel truss girder-pushing device, a steel plate is laid and spot-welded on a top surface of the slideway girder, and a stainless steel plate is welded on a top surface of the steel plate.

In the above three-truss continuous steel truss girder-pushing device, the middle slideway girder has an overall height less than the front and rear slideway girders, and is supported on the pier body via a padding stone.

In the above three-truss continuous steel truss girder-pushing device, a cushion block is provided on each of the vertical pushing jacks, and the cushion block is a standard steel ingot.

In the above three-truss continuous steel truss girder-pushing device, the sliding block includes a left sliding block body and a right sliding block body, wherein a plurality of left connecting arms being provided on a right side surface of the left sliding block body, a plurality of right connecting arms being provided on a left side surface of the right sliding block body, and the left connecting arms are hingedly connected with the right connecting arms, respectively.

In the above three-truss continuous steel truss girder-pushing device, a first strip-like protrusion is provided on a right end surface of each of the left connecting arms, and a first groove matched with the first strip-like protrusion is provided on a left end surface of each of the right connecting arms, with the first strip-like protrusions being inserted in the first grooves and being hinged with the first grooves via pins.

In the above three-truss continuous steel truss girder-pushing device, a pit is provided on a bottom surface of each of the left sliding block body and the right sliding block body, with a filling plate being fixed therein, and a sliding plate made of engineering plastic alloy is fixed to a bottom surface of the filling plate in such a manner that the bottom surfaces of the left sliding block body and the right sliding block body each is higher than the bottom surface of the sliding plate.

The present invention also provides an arrangement method for a three-truss continuous steel truss girder-pushing device, including the steps of:

A10, providing a row of concrete upright posts at each of the front and rear sides of the pier body in a bridge direction, wherein each row of concrete upright posts include three posts, the upright posts and the pier body form three groups of left, middle and right supporting structures in the bridge direction;

A20, providing a left side truss slideway girder, a right side truss slideway girder and a middle truss slideway girder on the three groups of left, middle and right supporting structures, respectively;

A30, making a bridge longitudinal length of each group of slideway girder to be larger than one segment of the steel truss girder, wherein each group of slideway girder is formed of a front, rear and middle slideway girders, the front and rear slideway girders are fixed to a pier cap and the concrete upright posts by pre-embedded members, the middle slideway girder is supported on the pier body via a padding stone, and both ends of the middle slideway girder are fixedly connected to the front and rear slideway girders via bolts; when the slideway girder is installed, a steel plate is laid and spot-welded on a top surface of the slideway girder, and a stainless steel plate is welded on a top surface of the steel plate so as to reduce friction; and A40, providing an operation platform at a front end of the front slideway girder of the left and right side truss slideway girders, wherein a horizontal continuous pushing jack is installed on the operation platform, and is anchored to a rear end of the steel truss girder via a cable, four vertical pushing jacks are provided in the front of each of the left and right side truss slideway girders and the middle truss slideway girder, and a cushion block is provided on each of the vertical pushing jacks, two sliding blocks are arranged side by side at the front and rear ends of each of the three groups of the slideway girders respectively, the sliding block located in the front of each slideway girder is disposed at the rear of the vertical pushing jack and is stopped from forward movement by a positioning block, and the steel truss girder is disposed as a whole on the above sliding blocks.

In the above method, cable accommodating pipes are disposed in the front slideway girder, in the rear slideway girder, and in the interior of the rear slideway girder in an axial direction in sequence, wherein the front end of the cable accommodating pipe located inside the front slideway girder faces the horizontal continuous pushing jack, and the rear end thereof is in the shape of a trumpet.

The present invention has the following beneficial effects:

(1) only two side trusses of the steel truss girder are pushed synchronously, while the middle truss slides passively, thereby improving the construction efficiency and reducing the construction costs.

(2) in the forward movement under pushing, only nodes of the steel truss girder are stressed, resulting in reasonable force.

(3) large temporary piers in rivers are removed, which facilitates preventing flood and resisting flood, avoiding the trouble in the later clearance of river channels.

(4) operations at sea are reduced, and the operation in factory may be performed on a supporter, thereby both ensuring the construction quality and shortening the work period effectively.

(5) by the adjustment and cooperation of the jacks and the sliding blocks, it is possible to avoid the fact that the pushing is difficult because the bottom chord of the integral segment of steel truss girder is hindered and thus cannot move forwardly at the same time when the integral segment passes through a hole, and it is also possible to avoid the bending and twisting of the integral segment.

DETAILED DESCRIPTION OF THE INVENTION

Hereinafter, the present invention will be described in detail in conjunction with specific embodiments and accompanying drawings.

Figure 1:
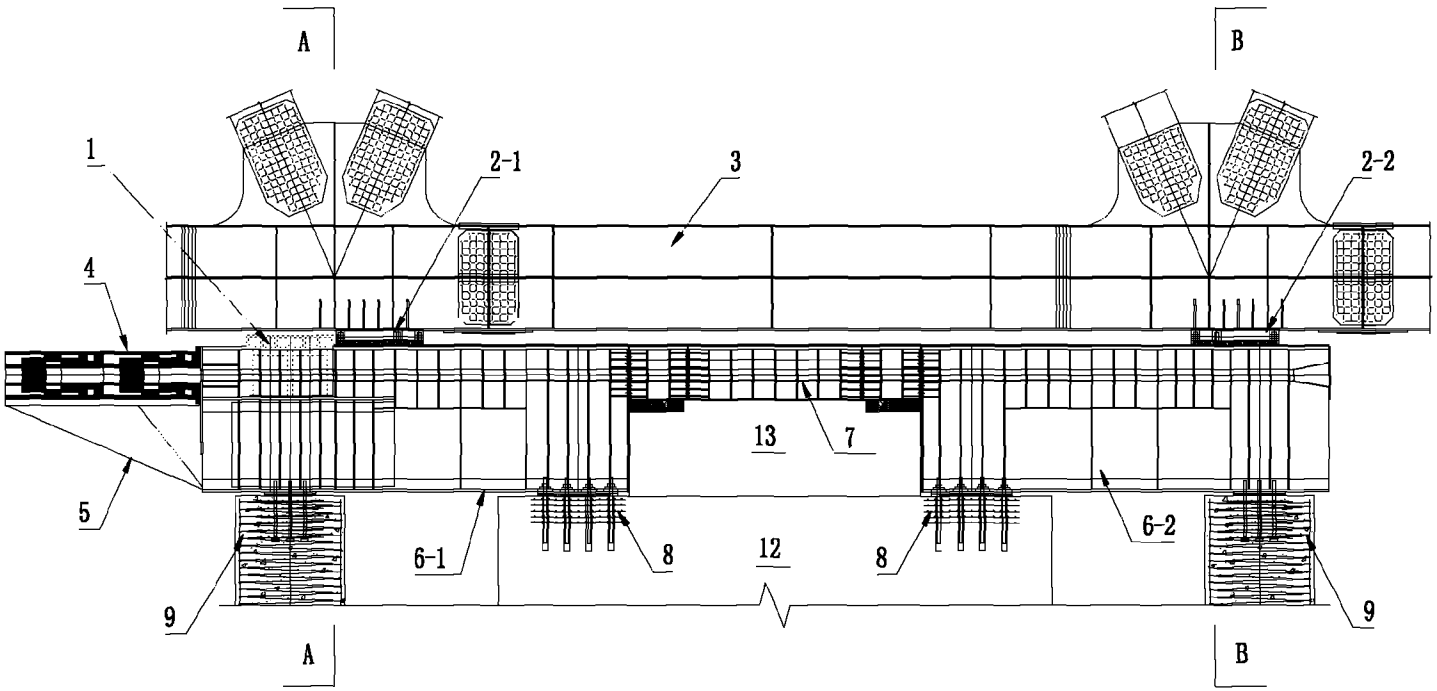
FIG. 1 is a view showing the arrangement of a side truss node pushing device of a steel truss girder according to the present invention.
Figure 2:
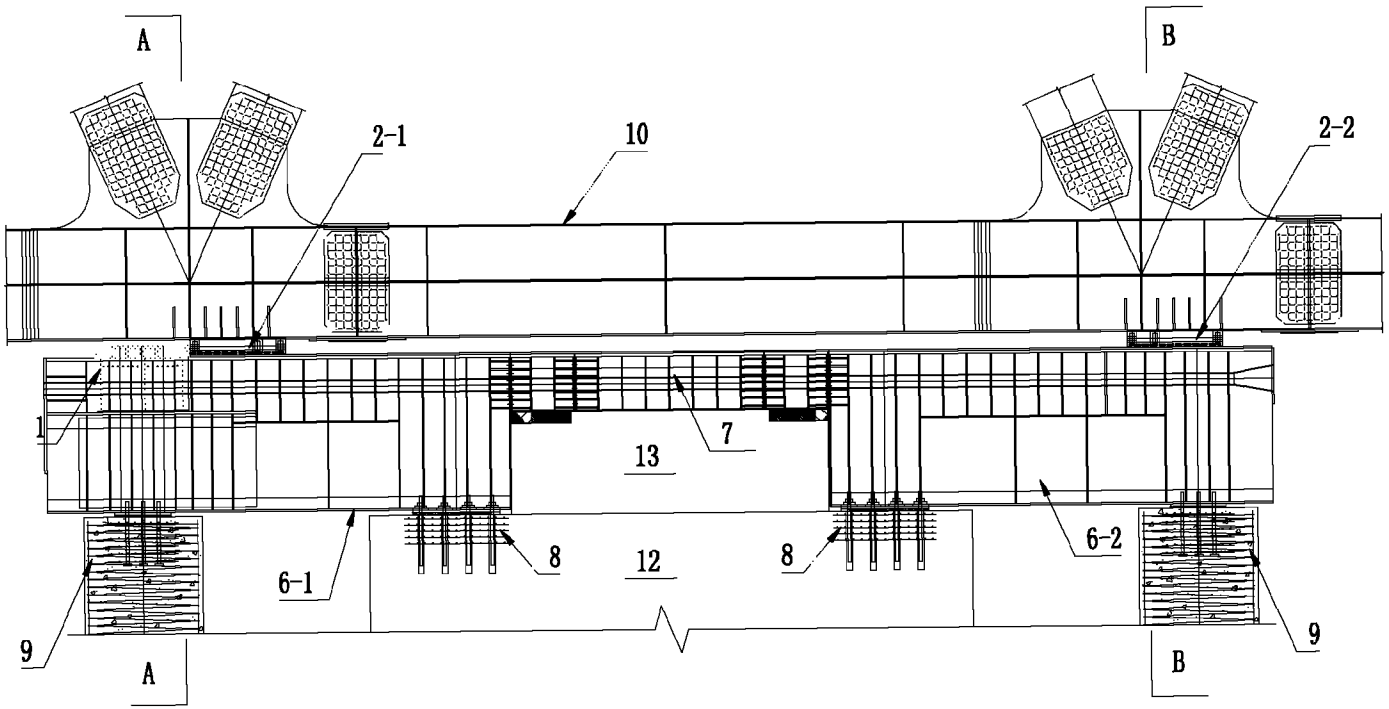
FIG. 2 is a view showing the arrangement of a middle truss node pushing device of a steel truss girder according to the present invention.
Figure 3:
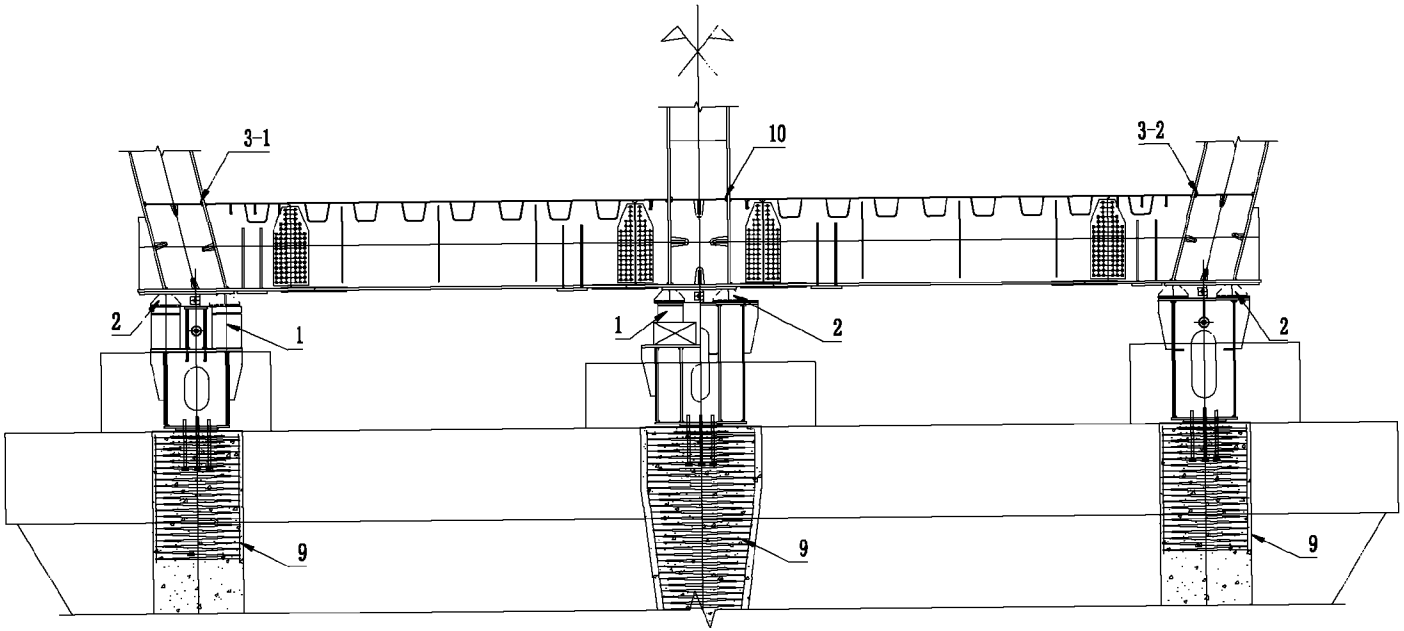
FIG. 3 is a sectional view taken along lines A-A, B-B in FIGS. 1 and 2.

This embodiment relates to a steel truss girder of a bridge used in both highway and railway. As shown in FIGS. 1 to 3, the steel truss girder is of a three-piece trussed structure which is formed of a middle truss 10 and a left and right side trusses 3-1 and 3-2. In the truss girder, one internode length is 12 m, and a horizontal continuous jack 4 is provided at each of two side trusses for pushing synchronically and continuously. The displacement of the two side trusses is monitored and feedback-adjusted such that the synchronous error theoretical value is within 0.2 mm. The two side trusses slide actively, while the middle truss is not provided with a horizontal pushing jack and slides passively.

The three-truss continuous steel truss girder-pushing device includes a supporting structure, a slideway girder and a pushing apparatus. Since one internode length of the steel truss girder is 12 m, the width of a pier body 12 is insufficient. In order to ensure only the node of the steel truss girder to be stressed in the pushing forward movement, and to meet the node-over-pier requirement, a row of concrete upright posts 9 are provided at each of the front and rear sides (the left side in FIG. 1 refers to the forward side) of the pier body 12 in a bridge direction. Each row of concrete upright posts are three in number, and together with the pier body, form three groups of left, middle and right supporting structures in the bridge direction.

Figure 6:
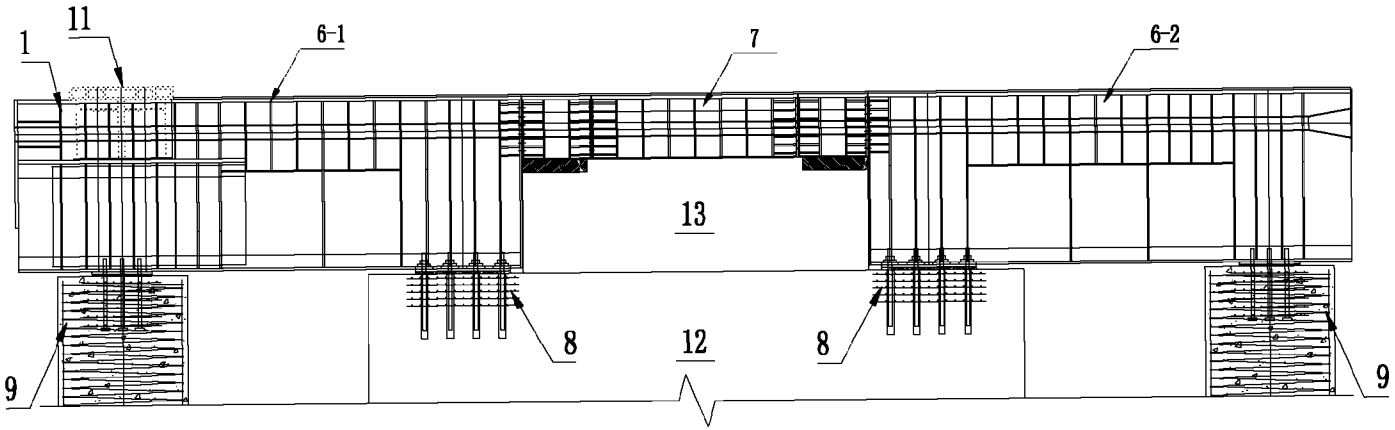
FIG. 6 is a structural view of a slideway girder of a left and right truss.
Figure 7:
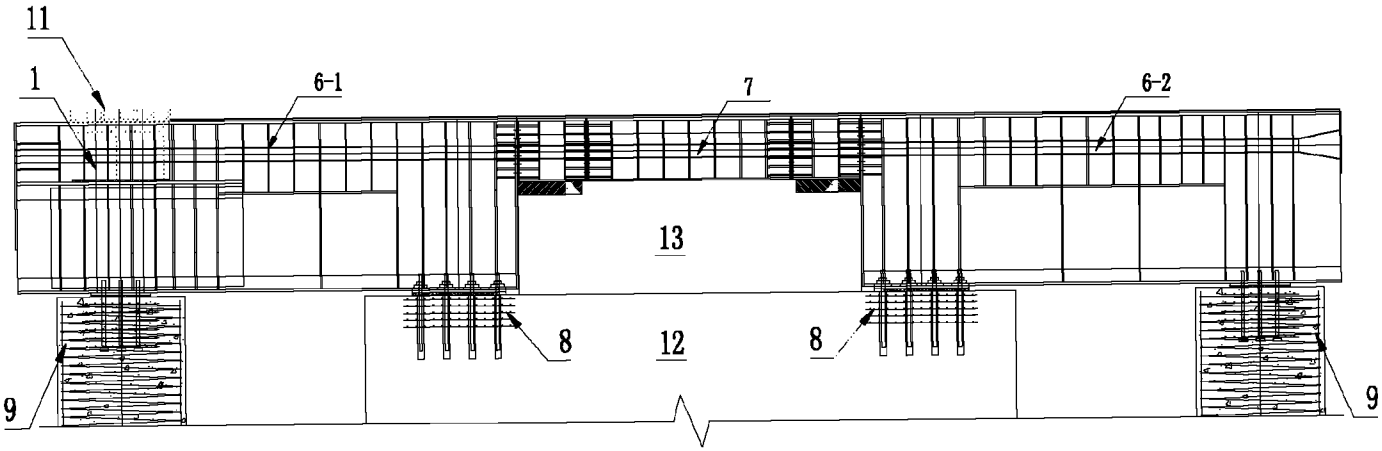
FIG. 7 is a structural view of a slideway girder of a middle truss.

The slideway girder includes three groups of slideway girders, i.e., left, right and middle slideway girders which are disposed on the three groups of left, middle and right supporting structures and correspond to the left and right side trusses 3-1, 3-2 and the middle truss 10 of the steel truss girder, respectively. Also in conjunction with FIGS. 6 and 7, each group of slideway girder has a bridge longitudinal length larger than 12 m, and is formed of a front and rear slideway girders 6-1, 6-2 and a middle slideway girder 7. The front and rear slideway girders 6-1, 6-2 are fixed to a pier cap of the pier body 12 (i.e., the bearing structure at the top of the pier body) and the concrete upright posts 9 by pre-embedded members 8, so as to resist a horizontal force generated in the forward movement of the steel truss girder. The middle slideway girder 7 is supported on the pier body 12 via a padding stone 13, and both ends of the middle slideway girder 7 are fixedly connected to the front and rear slideway girders 6-1, 6-2 via bolts. In this way, the middle slideway girder 7 has an overall height less than the front and rear slideway girders 6-1, 6-2. After the slideway girder is installed, a steel plate with the thickness of 20 mm is laid and spot-welded on the top of the slideway girder, and a stainless steel plate of 4 mm is welded on the top of the steel plate so as to reduce friction.

An operation platform 5 is provided in the front of the front slideway girder 6-1 of the left and right side truss slideway girders. The horizontal continuous pushing jack 4 is installed on the operation platform 5, and is anchored to the rear end of the steel truss girder via a cable. Four vertical pushing jacks 1 are provided in the front of each of the left and right side truss slideway girders and the middle truss slideway girder, and a cushion block 11 is provided on each of the vertical pushing jacks 1. The cushion block 11 is made of standard steel ingot, and is used to adjust the height of the steel truss girder. All the vertical pushing jacks 1 are controlled synchronically, and are used to lift vertically the steel truss girder simultaneously. Two sliding blocks 2-1 and 2-2 are arranged side by side at the front and rear ends of each of three groups of the slideway girders, respectively. The sliding block 2-1 located in the front of each slideway girder is disposed at the rear of the respective vertical pushing jack 1, and is stopped from forward movement by a positioning block. That is, when the sliding block 2-1 slides to the front end of the slideway girder, the sliding block 2-1 abuts against the positioning block so as to be prevented from moving on. The steel truss girder is disposed as a whole on the above sliding blocks.

When the pushing construction is desired, two horizontal continuous pushing jacks 4 push simultaneously the left and right side trusses of the steel truss girder, respectively. Then, the steel truss girder moves as a whole forwardly with the sliding block 2-2. When the steel truss girder of this segment is pushed forwardly by a distance of a segment, the sliding block 2-2 arrives at the front portion of the slideway girder, and moves forwardly no longer after abutting against the sliding block 2-1. At this moment, the vertical pushing jack 1 lifts the steel truss girder, and the sliding block 2-2 slides back to its original position so as to support the steel truss girder of the next segment. As such repeatedly, all of three-truss steel truss girder segments are pushed beyond the pier by the cooperation of the vertical pushing jack and the sliding block.

Figure 4:
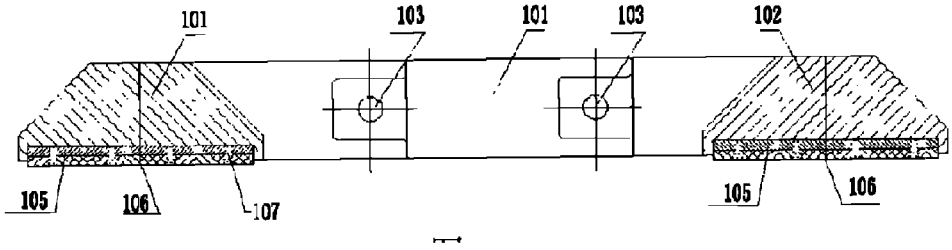
FIG. 4 is a structural schematic view of a sliding block.
Figure 5:
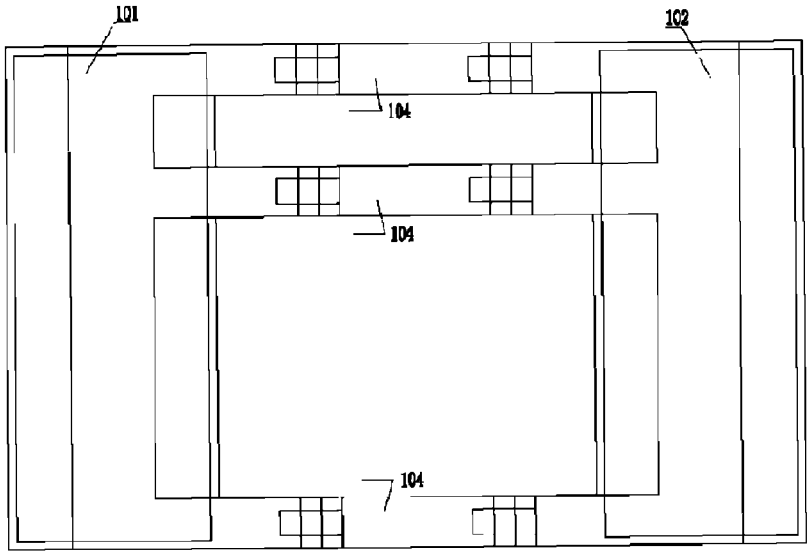
FIG. 5 is a top view of the sliding block.

FIG. 4 is a structural view of a sliding block, and FIG. 5 is a top view of the sliding block. As shown in FIGS. 4 and 5, the sliding block includes a left sliding block body 101 and a right sliding block body 102. A plurality of left connecting arms are provided on the right side surface of the left sliding block body 101, and a plurality of right connecting arms are provided on the left side surface of the right sliding block body 102. A first strip-like protrusion is provided on the right end surface of the left connecting arm, and a first groove matched with the first strip-like protrusion is provided on the left end surface of the right connecting arm. The first strip-like protrusion is inserted in the first groove and is hinged with the first groove via a pin 103.

In order to be applicable to a structural body with different width, the left sliding block body 101 and the right sliding block body 102 may be provided with regulating stems with different length, so as to adjust the distance between the left and right sliding block bodies 101, 102 by the regulating stems.

A pit is provided on the bottom surface of each of the left sliding block body 101 and the right sliding block body 102, with a filling plate 105 being fixed therein. A sliding plate 106 made of engineering plastic alloy (MGE high polymer material) is fixed to the bottom surface of the filling plate 105 via a plurality of sunk screws 107 in such a manner that the bottom surfaces of the left sliding block body 101 and the right sliding block body 102 each is higher than the bottom surface of the sliding plate 106. In this way, when the left and right sliding block bodies 101 and 102 are placed on the slideway, only the bottom surface of the sliding plate 106 is in contact with the slideway for the purpose of reducing the friction of the sliding surface. The sliding plate 106 of MGE high polymer material is characterized as having a strong ability of resisting compression and bearing load, and a small wear resistance and friction coefficient, for example, in the case of the compression strength larger than 25 Mpa, the friction coefficient is in the range of 0.03-0.05 after forming a friction pair with the stainless steel plate. The pits on the bottom surfaces of the left sliding block body 101 and the right sliding block body 102 may form lateral limitation to the sliding plates 106 and the filling plates 105.

Since the sliding block is formed by assembling the left and right sliding block bodies 101 of cast steel material, it is convenient to assemble and disassemble and to use. Also, in order to be adapted to the variation of a lower chord section of the three-truss steel truss girder, the width of the sliding block may be varied by the adjustment of the regulating stem. In order to reduce the friction of the sliding surface, the sliding plate 106 of MGE high polymer material having a thickness of 20 mm is inlaid in the bottom of the sliding block. The sliding plate 106 of MGE high polymer material is characterized as having a strong ability of resisting compression and bearing load, and a small wear resistance and friction coefficient, for example, in the case of the compression strength larger than 25 Mpa, the friction coefficient against the stainless steel plate is in the range of 0.03-0.05. In construction, the stainless steel plate is applied with grease so as to ensure the smooth slide. The slideway is kept from dust and other foreign matters, so as to prevent from scratching the MGE plate which could otherwise influence the utilization effect.

In order to control the position of the center line of the steel truss girder during pushing, a sliding guide groove is welded at the top of the slideway girder to restrict the lateral displacement of the sliding block 2. Cable accommodating pipes are disposed in the front slideway girder, in the rear slideway girder, and in the interior of the rear slideway girder in an axial direction in sequence. The front end of the cable accommodating pipe located inside the front slideway girder faces the horizontal continuous pushing jack 4, and the rear end thereof is in the shape of a trumpet in order to prevent the damage to the steel strand.

The arrangement method of the three-truss continuous steel truss girder-pushing device according to the present invention includes the steps of:

A10, providing a row of concrete upright posts at each of the front and rear sides of the pier body in a bridge direction, wherein each row of concrete upright posts include three posts, the upright posts and the pier body form three groups of left, middle and right supporting structures in the bridge direction;

A20, providing a left side truss slideway girder, a right side truss slideway girder and a middle truss slideway girder on the three groups of left, middle and right supporting structures, respectively;

A30, making a bridge longitudinal length of each group of slideway girder to be larger than one segment of the steel truss girder, wherein each group of slideway girder is formed of a front, rear and middle slideway girders, the front and rear slideway girders are fixed to a pier cap and the concrete upright posts by pre-embedded members, the middle slideway girder is supported on the pier body via a padding stone, and both ends of the middle slideway girder are fixedly connected to the front and rear slideway girders via bolts; when the slideway girder is installed, a steel plate with the thickness of 20 mm is laid and spot-welded on a top surface of the slideway girder, and a stainless steel plate of 4 mm is welded on a top surface of the steel plate so as to reduce friction;

A40, providing an operation platform at a front end of the front slideway girder of the left and right side truss slideway girders, wherein a horizontal continuous pushing jack is installed on the operation platform, and is anchored to a rear end of the steel truss girder via a cable, four vertical pushing jacks are provided in the front of each of the left and right side truss slideway girders and the middle truss slideway girder, and a cushion block is provided on each of the vertical pushing jacks, two sliding blocks are arranged side by side at the front and rear ends of each of the three groups of the slideway girders respectively, the sliding block located in the front of each slideway girder is disposed at the rear of the vertical pushing jack and is stopped from forward movement by a positioning block, and the steel truss girder is disposed as a whole on the above sliding blocks.

The present invention is not limited to the most preferred embodiment described above, and structural variations may occur to anyone upon the teaching of the present invention. The technical solutions same as or similar to the present invention all fall into the protection scope of the present invention.

What we claim is:

1. A three-truss continuous steel truss girder-pushing device, characterized by comprising:

three groups of left, middle and right supporting structures comprising a row of concrete upright posts which are disposed at each of the front and rear sides of the pier body in a bridge direction, wherein each row of concrete upright posts include three posts, and the upright posts and the pier body form the three groups of left, middle and right supporting structures in the bridge direction;

a slideway girder comprising three groups of a left and right side truss slideway girders and a middle truss slideway girder which are disposed on the three groups of left, middle and right supporting structures and correspond to the left and right side trusses and the middle truss of the steel truss girder respectively, wherein each group of slideway girder has a bridge longitudinal length larger than one segment of the steel truss girder and is formed of a front and rear slideway girders and a middle slideway girder, the front and rear slideway girders are fixed to a pier cap and the concrete upright posts by pre-embedded members, the middle slideway girder is supported on a pier body, and both ends of the middle slideway girder are fixedly connected to the front and rear slideway girders via bolts respectively; two sliding blocks are arranged side by side at the front and rear ends of each of the three groups of slideway girders respectively;

vertical pushing jacks and a horizontal continuous pushing jack, wherein an operation platform is provided in the front of the front slideway girder of the left and right side truss slideway girders, the horizontal continuous pushing jack is installed on the operation platform and is anchored to the rear end of the steel truss girder via a cable, four vertical pushing jacks are provided in the front of each of the left and right side truss slideway girders and the middle truss slideway girder, the sliding block located in the front of each slideway girder is disposed at the rear of the respective vertical pushing jack, and is stopped from forward movement by a positioning block.

2. The three-truss continuous steel truss girder-pushing device according to claim 1, characterized in that a steel plate is laid and spot-welded on a top surface of the slideway girder, and a stainless steel plate is welded on a top surface of the steel plate.

3. The three-truss continuous steel truss girder-pushing device according to claim 1, characterized in that the middle slideway girder has an overall height less than the front and rear slideway girders, and is supported on the pier body via a padding stone.

4. The three-truss continuous steel truss girder-pushing device according to claim 1, characterized in that a cushion block is provided on each of the vertical pushing jacks, and the cushion block is a standard steel ingot.

5. The three-truss continuous steel truss girder-pushing device according to claim 1, characterized in that each of the sliding blocks comprises: a left sliding block body, a plurality of left connecting arms being provided on a right side surface of the left sliding block body; and a right sliding block body, a plurality of right connecting arms being provided on a left side surface of the right sliding block body, wherein the left connecting arms are hingedly connected with the right connecting arms, respectively.

6. The three-truss continuous steel truss girder-pushing device according to claim 5, characterized in that a first strip-like protrusion is provided on a right end surface of each of the left connecting arms, a first groove matched with the first strip-like protrusion is provided on a left end surface of each of the right connecting arms, the first strip-like protrusions are inserted in the first grooves and are hinged with the first grooves via pins.

7. The three-truss continuous steel truss girder-pushing device according to claim 6, characterized by further comprising a plurality of regulating stems, wherein a second groove matched with the first strip-like protrusions on the right end surface of each of the left connecting arms is provided on a left end surface of each of the regulating stems, a second trip-like protrusion matched with the first groove on the left end surface of each of the right connecting arms is provided on a right end surface of each of the regulating stems, the first strip-like protrusions are inserted in the second grooves and are hinged with the second grooves via pins, and the second strip-like protrusions are inserted in the first grooves and are hinged with the first grooves via pins.

8. The three-truss continuous steel truss girder-pushing device according to claim 5, characterized in that a pit is provided on a bottom surface of each of the left sliding block body and the right sliding block body, with a filling plate being fixed therein, a sliding plate made of engineering plastic alloy is fixed to a bottom surface of the filling plate in such a manner that the bottom surfaces of the left sliding block body and the right sliding block body each is higher than the bottom surface of the sliding plate.

9. The three-truss continuous steel truss girder-pushing device according to claim 6, characterized in that a pit is provided on a bottom surface of each of the left sliding block body and the right sliding block body, with a filling plate being fixed therein, a sliding plate made of engineering plastic alloy is fixed to a bottom surface of the filling plate in such a manner that the bottom surfaces of the left sliding block body and the right sliding block body each is higher than the bottom surface of the sliding plate.

10. The three-truss continuous steel truss girder-pushing device according to claim 7, characterized in that a pit is provided on a bottom surface of each of the left sliding block body and the right sliding block body, with a filling plate being fixed therein, a sliding plate made of engineering plastic alloy is fixed to a bottom surface of the filling plate in such a manner that the bottom surfaces of the left sliding block body and the right sliding block body each is higher than the bottom surface of the sliding plate.

11. An arrangement method of a three-truss continuous steel truss girder-pushing device, characterized by comprising the steps of:

A10, providing a row of concrete upright posts at each of the front and rear sides of the pier body in a bridge direction, wherein each row of concrete upright posts include three posts, the upright posts and the pier body form three groups of left, middle and right supporting structures in the bridge direction;

A20, providing a left side truss slideway girder, a right side truss slideway girder and a middle truss slideway girder on the three groups of left, middle and right supporting structures, respectively;

A30, making a bridge longitudinal length of each group of slideway girder to be larger than one segment of the steel truss girder, wherein each group of slideway girder is formed of a front, rear and middle slideway girders, the front and rear slideway girders are fixed to a pier cap and the concrete upright posts by pre-embedded members, the middle slideway girder is supported on the pier body via a padding stone, and both ends of the middle slideway girder are fixedly connected to the front and rear slideway girders via bolts; when the slideway girder is installed, a steel plate is laid and spot-welded on a top surface of the slideway girder, and a stainless steel plate is welded on a top surface of the steel plate so as to reduce friction; and A40, providing an operation platform at a front end of the front slideway girder of the left and right side truss slideway girders, wherein a horizontal continuous pushing jack is installed on the operation platform, and is anchored to a rear end of the steel truss girder via a cable, four vertical pushing jacks are provided in the front of each of the left and right side truss slideway girders and the middle truss slideway girder, and a cushion block is provided on each of the vertical pushing jacks, two sliding blocks are arranged side by side at the front and rear ends of each of the three groups of the slideway girders respectively, the sliding block located in the front of each slideway girder is disposed at the rear of the vertical pushing jack and is stopped from forward movement by a positioning block, and the steel truss girder is disposed as a whole on the above sliding blocks.

12. The arrangement method of the three-truss continuous steel truss girder-pushing device according to claim 11, characterized in that cable accommodating pipes are disposed in the front slideway girder, in the rear slideway girder, and in the interior of the rear slideway girder in an axial direction in sequence, wherein the front end of the cable accommodating pipe located inside the front slideway girder faces the horizontal continuous pushing jack, and the rear end thereof is in the shape of a trumpet.

* * * * *